US005232099A

United States Patent [19]

Maynard

[11] Patent Number: 5,232,099

[45] Date of Patent: Aug. 3, 1993

[54] CLASSIFYING APPARATUS AND METHOD

[75] Inventor: Michael W. Maynard, New Bedford, Ill.

[73] Assignee: Production Engineered Products, Inc., Walnut, Ill.

[21] Appl. No.: 868,991

[22] Filed: Apr. 15, 1992

[51] Int. Cl.[5] ..... B07B 1/28

[52] U.S. Cl. ..... 209/311; 209/276; 209/314; 209/366.5; 209/381

[58] Field of Search ..... 209/276–278, 209/311, 314, 322, 324, 364, 366.5, 381, 365.1, 365.4

[56] References Cited

U.S. PATENT DOCUMENTS

| | | | |
|---|---|---|---|
| 2,077,678 | 4/1937 | Delamater . | |
| 2,311,814 | 2/1943 | Behnke et al. . | |
| 2,345,947 | 4/1944 | Parks . | |
| 3,468,418 | 9/1969 | Renner . | |
| 3,642,133 | 2/1972 | Venanzetti | 209/314 |
| 3,666,095 | 5/1972 | Krynock et al. . | |
| 3,796,311 | 3/1974 | Krause . | |
| 3,825,118 | 7/1974 | Feller | 209/365.4 |
| 3,954,604 | 5/1976 | Krause et al. . | |
| 4,082,657 | 4/1978 | Gage | 209/311 |
| 4,319,993 | 3/1982 | Krause . | |
| 4,444,656 | 4/1984 | Nelson et al. . | |
| 4,482,455 | 11/1984 | Humphrey | 209/366.5 |
| 4,732,670 | 3/1988 | Nelson | 209/314 |

FOREIGN PATENT DOCUMENTS 2701341 1/1977 Fed. Rep. of Germany .

*Primary Examiner*—Joseph E. Valenza

*Attorney, Agent, or Firm*—Lockwood, Alex, FitzGibbon & Cummings

[57] ABSTRACT

Classifying apparatus and methods are disclosed for the classification of extremely small solid particles of 18 mesh or less in which low frequency, high amplitude vibrations are imparted to a screen simultaneously with high frequency, low amplitude vibrations. The screen may be inclined at an angle of about 20° from the horizontal and the screen mesh may be about 18 mesh or smaller and have openings which are approximately square in shape.

59 Claims, 3 Drawing Sheets

CLASSIFYING APPARATUS AND METHOD

BACKGROUND AND SUMMARY OF THE INVENTION

The present invention relates to classifying apparatus and method and, more particularly, to a vibrating screening deck and method of classifying and separating solid particulate materials of larger and smaller sizes from each other.

Vibrating screening decks have been widely used in the past in the classification and separation of particulate solids of varying particle sizes and compositions, such as limestone, coal and ores. Such screening decks have typically comprised a generally rectangular frame which is suspended in operation and which has a screen cloth in the frame upon which the materials to be classified are deposited. The frame and screen in such decks are suspended at an angle inclined from the horizontal, and at least the screen is vibrated to cause the solid particulates to move down the screen. As the materials move down the vibrating screen solids of smaller mesh size pass through the screen as "unders", and solids of larger particle size are discharged from the lower end of the screen as "overs".

One advanced form of such prior screening deck is disclosed in U.S. Pat. No. 4,444,656. That screening deck comprises a rigid frame in which the screens of the deck are mounted in the frame on resilient mountings. The screens are vibrated directly and independently of the frame by vibrating tappets which bear against the underside of the screens to impart high frequency, low amplitude vibrations directly to the screen. The advantages of the apparatus and method disclosed in the patent are that a substantial reduction in power consumption, apparatus weight and frequency of maintenance are realized over the screening apparatus and methods known previously.

Screening decks and methods as disclosed in U.S. Pat. No. 4,444,656 function quite well in the separation of particulate solids where the "unders" are larger than about 18 mesh. Where the "unders" exceed a size of 18 mesh, the screening deck is typically inclined at approximately 38°±5°. This is the angle of repose of most materials and at this angle the particulate materials slide down the vibrating screens by gravity. The ±5° is adjusted to control the bed depth of the solid particulates on the screen which in turn controls to a degree the gradation of the materials that is to be separated.

At the foregoing 38° angle of incline, screens are typically employed in which the mesh is formed with slotted rectangular openings to compensate for the relatively steep angle of incline of the screens. If a mesh having square openings was used, the gradation of the material would be effected to produce more fines because the particulate solids sliding across the surface of the screen do not actually meet the opening perpendicular to the screen at such incline. However, when screening "unders" below an 18 mesh opening, the rectangular slotted weave is no longer practical because wire cloth manufacturers either cannot weave such screens or, if they can, the cost becomes prohibitively high in such slotted configurations at such small mesh sizes. The present invention was developed to overcome the foregoing disadvantages.

In the present invention much finer gradations of smaller sized particles of "unders" are possible, and a square opening mesh which is readily and relatively inexpensively available in sizes as small as or smaller than 40 mesh may be utilized in place of the rectangular opening screens. Moreover, the likelihood of pegging or plugging of the screens having these small mesh sizes is substantially reduced by the apparatus and method of the present invention as will be described in more detail to follow.

In one principal aspect of the present invention classifying apparatus for separating particulate solids of larger and smaller sizes from each other includes a frame, at least one screen having openings therein to permit the passage of the smaller particulate solids therethrough, and mounting means for mounting the screen in the frame. First vibration means imparts high frequency, low amplitude vibrations to the screen and second vibration means imparts low frequency, high amplitude vibrations to the screen simultaneously with the high frequency, low amplitude vibrations.

In another principal aspect of the present invention a method of separating particulate solids of smaller and larger sizes from each other comprises introducing the solids to be separated to the inlet end of an inclined screen having openings therethrough and which is mounted in a frame, imparting high frequency, low amplitude vibrations to the screen while simultaneously imparting low frequency, high amplitude vibrations to the screen, and removing the smaller size particulate solids which pass through the vibrating screen and the larger size particulate solids which do not pass through the vibrating screen.

In still another principal aspect of the present invention, the foregoing first vibration means imparts the high frequency, low amplitude vibrations directly to the screen to vibrate the screen independently of the frame.

In still another principal aspect of the present invention, mounting means mounts the second vibration means to the frame to impart the low frequency, high amplitude vibrations to the frame and the screen.

In still another principal aspect of the present invention, the particulate solids to be separated are sequentially passed across a pair of screens, and each of the screens are vibrated with high frequency, low amplitude vibrations by the first vibration means independently of each other.

In still another principal aspect of the present invention, the high frequency, low amplitude vibrations have a frequency of between about 1,000–7,000 vpm and an amplitude of between 600–1,350 cfp and the low frequency, high amplitude vibrations have a frequency of between 900–3,600 vpm and an amplitude of between about 0–7850 cfp, and the frequency and amplitude of the high frequency, low amplitude vibrations are higher and lower respectively than the frequency and amplitude of the low frequency, high amplitude vibrations.

In still another principal aspect of the present invention, the aforementioned screen is inclined at an angle of about 20° from the horizontal.

In still another principal aspect of the present invention, the openings in the screen are about 18 mesh or smaller in size, and the openings are approximately square in shape.

These and other objects, features and advantages of the present invention will be clearly understood through a consideration of the following detailed description.

BRIEF DESCRIPTION OF THE DRAWINGS

In the course of this description, reference will frequently be made to the attached drawings in which.

DESCRIPTION OF THE PREFERRED EMBODIMENT

Figure 1:
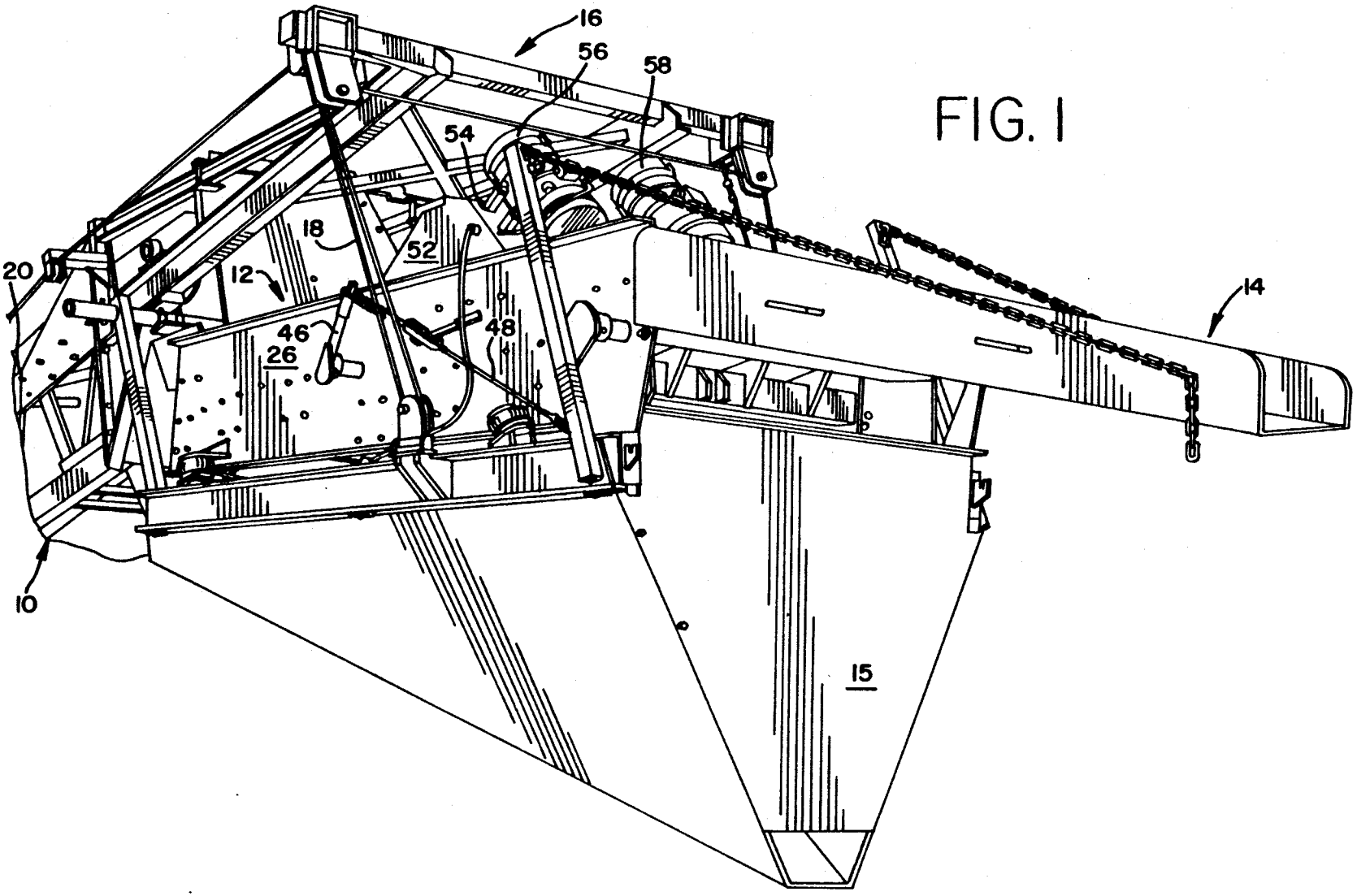
FIG. 1 is an overall perspective view of a preferred embodiment of a classifying apparatus of the present invention and which is capable of practicing the method of the present invention.

An overall view of a classifying assembly which incorporates a preferred embodiment of apparatus and is capable of performing the preferred method of the present invention is shown in FIG. 1. Generally, the assembly comprises a conveyor unit 10, the vibrating screening deck 12 of the present invention as will be described in more detail to follow, chutes 14 and 15 for the discharge of "overs" and "unders" respectively, and a cantilevered support structure 16 for supporting the screening deck 12 and adjusting its incline via cables 18. With the exception of the screening deck 12 which will be more fully described to follow, the foregoing components are generally conventional in the particulate solids classifying art and will not be described to follow in explicit detail.

Referring particularly to FIG. 1, the conveyor unit 10 generally comprises a rigid frame structure 20 suitable for supporting a moving conveyor therein, such as an endless conveyor belt (not shown) for transporting the particulate solid materials to be classified to the top or inlet end 22 of the screening deck 12 where they are discharged onto the deck.

Figure 2:
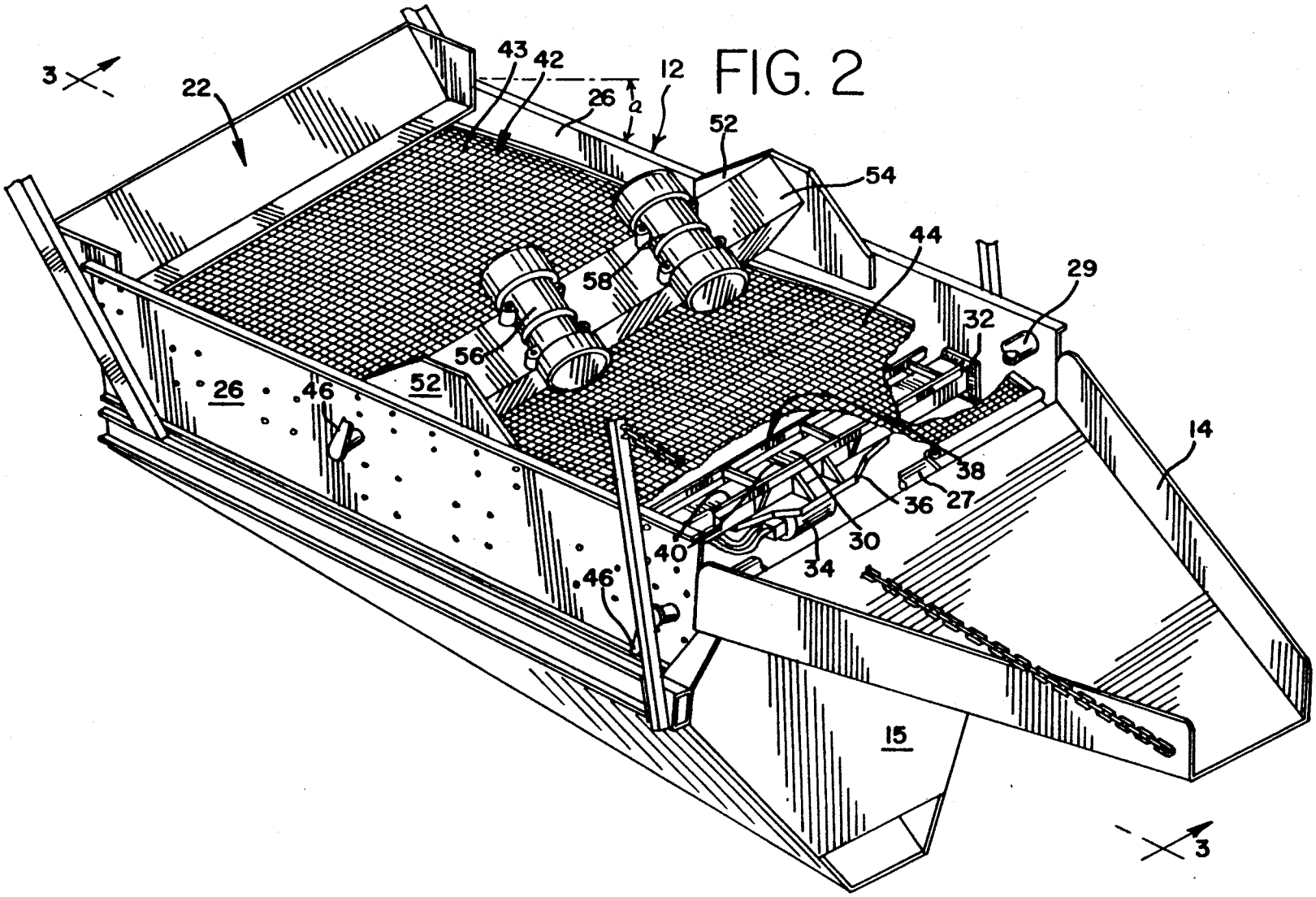
FIG. 2 is a partially broken, perspective view from the top of the apparatus substantially as shown in FIG. 1.

The screening deck 12 preferably comprises a rigid rectangular frame generally 24 having a pair of elongate, longitudinally extending, spaced parallel side members 26, such as the channels as shown in FIG. 2. The elongate side members 26 are held in spaced apart, generally parallel relationship to each other by transversely extending members, such as rotatable screen mounting tubes 27 and 28, as best shown in FIGS. 2 and 3, and by fixed tubes 29 such as to form an essentially box like structure.

Figure 3:
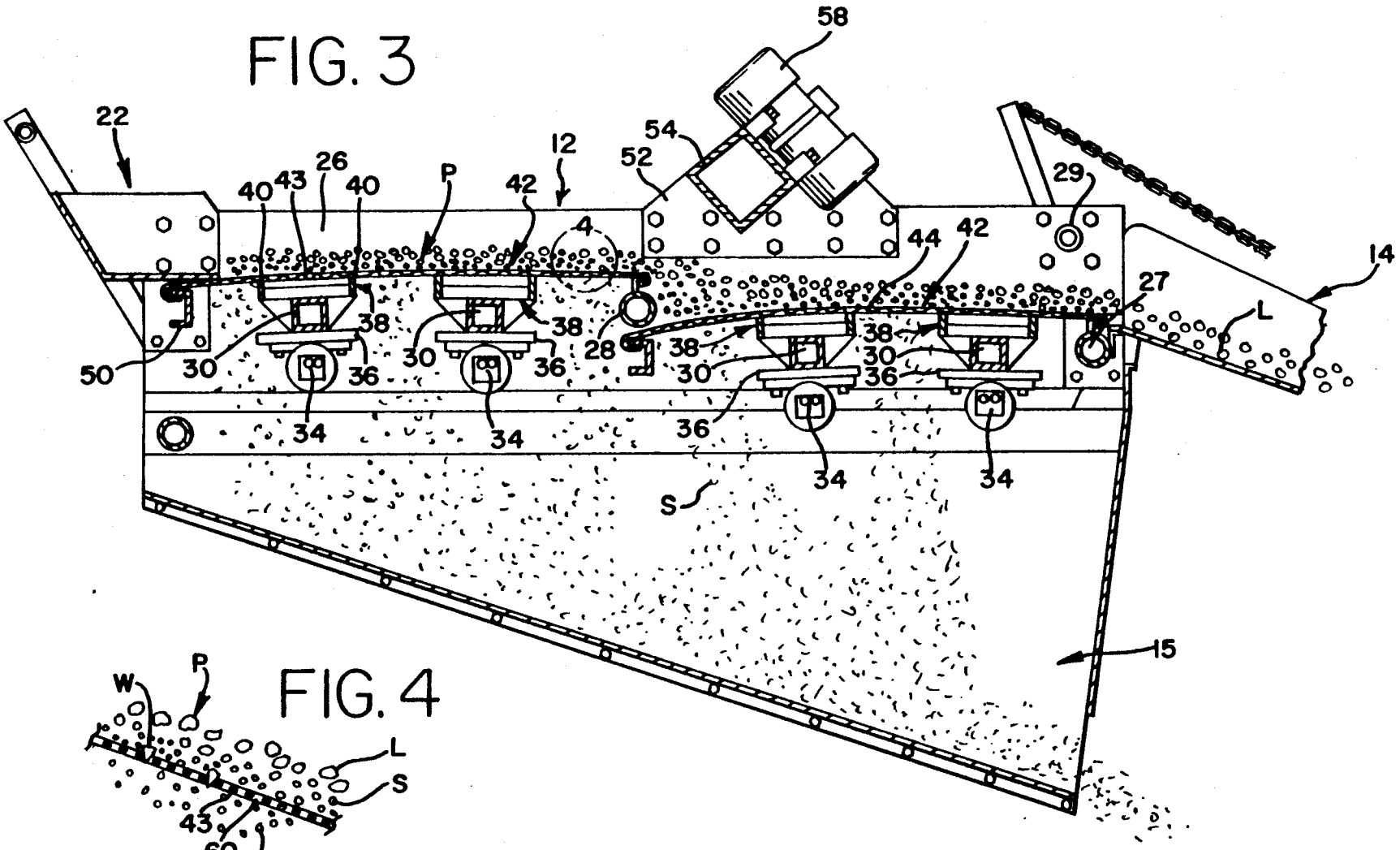
FIG. 3 is a cross-sectioned, side elevation view of the apparatus as viewed substantially along lines 3—3 of FIG. 2.

A plurality of rigid beams 30 also extend transversely across the screening deck between the side members 26 as best seen in FIGS. 2 and 3. The rigid beams 30 preferably comprise rectangular tubes the ends of which are affixed to the side members 26 of the frame 24 via resilient mountings 32 as shown in FIG. 2. The resilient mountings 32 permit the beams and the vibration imparting mechanisms thereon to vibrate independently of the frame 24 and permit the beams 30 at least some measure of limited rocking motion relative to the side members 26 for a purpose to be later described.

A vibrator motor 34 is suspended from a plate 36 which, in turn, is affixed to each of the rigid beams 30 as best seen in FIG. 3, as by welding. The vibrator motor 34 may be either electric or hydraulic, although hydraulic is preferred. Each of these motors 34, vibrates at a high frequency, low amplitude, as will be described in further detail to follow, and the frequency and/or amplitude of each is preferably separately controlled.

A tappet assembly, generally 38, having a pair of spaced parallel bars 40 is fixed to the top of each of the rigid beams 30, again preferably by welding.

The screening deck thus far described is substantially identical to the screening deck, tappet assembly and vibrator motor arrangement as described in U.S. Pat. No. 4,444,656 and the disclosure in that patent is hereby incorporated by reference. As disclosed in the aforementioned patent, the tappet assemblies 38 and their vibrator motors 34 impart a high frequency, low amplitude vibration directly to a meshed screening material generally 42 as seen in FIGS. 2 and 3, the latter of which is tensioned over the tops of the tappet assemblies so that the underside of the screening material is in contact with the parallel bars 40 of the tappet assemblies and is directly supported by the bars 40. The meshed screening material 42 preferably comprises two screen panels 43 and 44 at the inlet and discharge ends, respectively, of the screening deck 12. Each of the screen panels 43 and 44 is tensioned over the bars 40 of the tappet assembly 38 so as to be slightly arched over their length. The vibrator motors 34 are preferably adjusted so as to impart vibrations of somewhat different frequencies and/or amplitudes to the respective screen panels 43 and 44. The tappet assemblies 38 are capable of rocking somewhat about the resilient mountings 32 to permit them to firmly contact the panels when the screen panels are tensioned and directly support the panels.

Each of the screen panels 43 and 44 is accurately and precisely tensioned utilizing the rotatable tubes 27 and 28, as shown in FIG. 3, the levers 46 as shown in FIGS. 1 and 2, and tensioning cables 48 as shown in FIG. 1. The tensioning mechanism will not be further described in detail herein because a preferred form is disclosed in detail in U.S. Pat. No. 4,732,670, the disclosure of which is incorporated herein by reference. In addition, fixed anchors such as 50, as generally shown in FIG. 3, are preferably of the construction either as disclosed in the latter mentioned patent, and even more preferably as disclosed in detail in U.S. Pat. No. 4,906,352, the disclosure of which is also incorporated herein by reference.

The screening deck and screen panel tensioning mechanisms thus far described are essentially as disclosed in the aforementioned patents. As previously mentioned, such decks function quite satisfactorily for the separation of particulate solids down to sizes of about 18 mesh. These screening decks are typically adjusted by the cantilevered support structure 16 and cables 18, as shown in FIG. 1, to an incline of about 38°±5° from the horizontal. At this incline, which is the angle of repose of most materials down the screen panels 43 and 44. The high frequency, low amplitude vibrations which are imparted directly to the screen panels 43 and 44 via the vibrator motors 34 and tappet assemblies 38 stratify the layer P of particulate solids on the screen to cause the smaller size particles to congregate toward the bottom of the layer adjacent the screens and pass through the screens as "unders" to be discharged via the chute 15. The larger size particulate solids continue down the screen panels and are discharged as "overs" via the chute 14.

Because of the relatively steep 38°±5° incline of the screening deck 12, the mesh openings in the screen panels 43 and 44 are generally formed as rectangular slots which extend in the direction of movement of the material down the screens. Due to this rectangular shape and the incline of the screen panels 43 and 44, the rectangular slots present the appearance of approximately square to the particulate solids as viewed in vertical plan. If the openings were square, they would present the appearance to the particulate solids in the vertical plan of shorter than square in the direction of movement of the solids down the screen panels and pegging of the openings would occur.

Screen inclines of the magnitude described with the rectangular slotted openings perform in an excellent manner for sizes down to about 18 mesh. However, if it is desired to classify particulate solids to mesh sizes smaller than 18 mesh, difficulties are experienced because wire cloth manufacturers cannot weave the screen panels into a slotted configuration at such small mesh sizes or, if they can, the screen mesh becomes very expensive. It is the purpose of the present invention to inexpensively and simply permit the classification of solid particulates having sizes of 18 mesh or smaller and, at the same time, to eliminate screen pegging or plugging problems which might otherwise occur with such small mesh sizes.

In order to achieve the foregoing objectives in the present invention, heavy rigid panels 52 are mounted to each of the frame side members 26 so as to extend above the tops of the side members. A heavy rigid mounting tube 54 is fixed between the panels 52 so as to extend transversely across the screening deck 12 and a pair of vibrator motors 56 and 58 are mounted in spaced relationship along the mounting tube 54. These vibrators may be either electrically or hydraulically operated, but are preferably electrically operated. Important in the present invention is that the vibrator motors produce vibrations of low frequency and high amplitude as compared to the high frequency, low amplitude vibrations generated by the vibrators 34. These low frequency, high amplitude vibrations are imparted to the frame 24 and then to the screen panels 43 and 44 which are mounted in the frame simultaneously with the high frequency, low amplitude vibrations imparted by the vibrators 34 and tappet assemblies 38 directly to the screen panels.

Due to the presence of this low frequency, high amplitude vibration, the angle of incline of the screening deck 12 may now be reduced to an angle substantially less than the 38° as in the prior classifiers. It may be reduced to approximately 20°. A 20° angle of incline would normally be insufficient to move the particulate solids down the screen by gravity. However, the low frequency, high amplitude vibrations imparted to the frame and the screen panels 43 and 44 function to convey the material down the screen at this lesser angle of inclination.

Also because of this lesser angle of inclination, the rectangular screen openings as utilized in the prior classifiers may also be eliminated, and instead openings approximately square in shape may now be employed. Such square opening mesh is available in smaller mesh sizes of 20, 30 and even 40 mesh sizes at relatively inexpensive prices.

Figure 4:
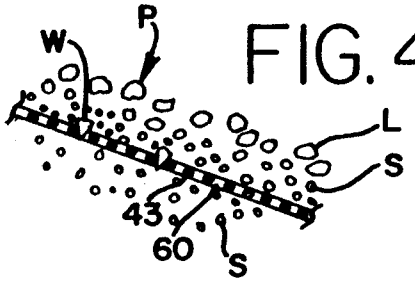
FIG. 4 is an enlarged schematic view of a portion of the screen and layer of particulate solids thereon as viewed substantially within the circle 4 of FIG. 3.

It is believed that the apparatus and method of the present invention efficiently and affectively function as follows. As the layer P of particulate solids is formed on the screen, the layer becomes stratified as shown in FIG. 4 with the particulate solids of smaller size S moving toward the bottom of the layer and adjacent the screen panel 43, while the particulate solids of larger size L remain near the top of the layer P. This stratification is the result of the high frequency, low amplitude vibrations which are imparted directly to the screen panels 42 and 43.

The very smallest of the particulate solids S readily pass through the openings 60 in the screen panel 43 as viewed in FIG. 4. However, many of these small solids S are irregularly shaped and may, for example, take the form of wedge shaped particles which dimensionally vary over their widths and lengths. When these wedge shaped solids, such as W as shown in FIG. 4, enter the screen opening 60, they will tend to peg or plug the opening if the maximum dimension of the particles is about equal to or slightly greater than the dimensions of the opening. This was not as much of a problem where the openings were rectangular as in the prior screens, because the rectangular openings have a maximum dimension which is relatively large so as to permit such wedge shaped solids W to pass through the screen without pegging it. However, where the openings 60 are square shaped, the longer maximum dimension is not present and plugging or pegging does become a concern.

In the present invention plugging or pegging is effectively eliminated due to the presence of both the high frequency, low amplitude and low frequency, high amplitude vibrations which are simultaneously imparted to the screens. Referring again to FIG. 4, as the wedge shaped solid particle W moves into an opening 60 as shown so as to tend to peg the opening, it is prevented from pegging the opening by the high frequency, low amplitude vibrations. Those vibrations tend to cause the solid particle W to dance in the opening 60 without becoming firmly lodged in it. The low frequency, high amplitude vibrations cause this dancing solid particle W to be thrown up and away from the opening and it moves down the meshed screening material 42 until it is finally discharged as an "over" in chute 14.

The high frequency, low amplitude vibrators 34 in the present invention preferably operate at a frequency in a range of about 1,000–7,000 vpm and at an amplitude in a range of about 600–1,350 cpf (centrifugal force pounds) which is about 10–15 thousandth of an inch. The low frequency, high amplitude vibrators 56 and 58 preferably operate at a frequency in a range of about 900–3600 vpm and at an amplitude in a range of about 0–7850 cfp. That is about 1/16–3/16 inch. Although some of these frequency and amplitude ranges overlap, in any given classifier or method employing the principles of this invention, the high frequency, low amplitude vibrators 34 will operate at a higher frequency and lower amplitude respectively than the low frequency, high amplitude vibrator motors 56 and 58.

The low frequency, high amplitude vibrator motors 56 and 58 are preferably mounted to extend and to vibrate, as shown in FIG. 2, in the direction of movement of the particulate solids down the meshed screening material 42, rather than transversely of the screening deck 12. One of the low frequency, high amplitude vibrator motors preferably operates in a clockwise direction and the other in a counterclockwise direction. Those directions of operation may either be outward toward the side members 26 of the frame 24 or inward toward each other without adversely affecting the performance. However, if the low frequency, high amplitude vibrator motors were turned sideways, the vibratory motions imparted to the frame would be additive and circular and would thus reduce the strength of the vibrations which they impart to the frame 24 and the meshed screening material 42.

By way of example only, it has been found that screening decks having the following frequencies and amplitudes according to the invention perform quite satisfactorily in the classification of agricultural line of mesh sizes of 18 mesh or smaller and where the screen panels are inclined at approximately 20° and have approximately square openings:

| | FREQUENCY | AMPLITUDE |
|---|---|---|
| Lo Freq. Hi Amp. | 1800 vpm | 3900 cfp |
| Hi Freq. Lo Amp. to Screen 43 | 4600 vpm | 900 cfp |
| Hi Freq. Lo Amp. to Screen 44 | 3000 vpm | 760 cfp |

It will be understood that the embodiment of the present invention which has been described is merely illustrative of a few of the applications of the principles of the invention. Numerous modifications may be made by those skilled in the art without departing from the true spirit and scope of the invention.

I claim:

1. Classifying apparatus including a longitudinally extending screening deck for separating particulate solids of larger and smaller sizes from each other as the solids move longitudinally along the deck, said screening deck comprising:

a longitudinally extending frame;

at least one substantially planar screen having openings therein to permit the passage of the smaller particulate solids therethrough;

mounting means for mounting said screen in said frame;

first vibration means for imparting high frequency, low amplitude vibrations directly to said screen to exert forces on said screen in a direction transverse to the plane of the screen; and second vibration means mounted on said frame intermediate its longitudinal length and imparting low frequency, high amplitude vibrations to said frame and to said screen therein simultaneously with said high frequency, low amplitude vibrations imparted to said screen and to also exert forces on said screen in a direction transverse to the plane of the screen, the transverse high frequency and low frequency forces preventing particulate solids from pegging in the screen openings.

2. The apparatus of claim 1, wherein said first vibration means imparts said high frequency, low amplitude vibrations to vibrate the screen independently of said frame.

3. The apparatus of claim 2, including resilient mounting means mounting said first vibration means to said frame.

4. The apparatus of claim 1, including a pair of said screens, each of said screens being vibrated by said first vibration means independently of each other.

5. The apparatus of claim 4, wherein said first vibration means imparts said high frequency, low amplitude vibrations directly to each of said screens to vibrate the screens independently of each other and of said frame; resilient mounting means mounting said first vibration means to said frame; and said second vibration means imparting said low frequency, high amplitude vibrations to the frame and to each of the screens.

6. The apparatus of claim 5, wherein said high frequency, low amplitude vibrations have a frequency of between about 1000–7000 vpm and an amplitude of between about 600–1350 cfp, and said low frequency, high amplitude vibrations have a frequency of between about 900–3600 vpm and an amplitude of between about 0–7850 cfp, the frequency and amplitude of said high frequency, low amplitude vibrations being higher and lower respectively than the frequency and amplitude of said low frequency, high amplitude vibrations.

7. The apparatus of claim 1, wherein said high frequency, low amplitude vibrations have a frequency of between about 1000–7000 vpm and an amplitude of between about 600–1350 cfp, and said low frequency, high amplitude vibrations have a frequency of between about 900–3600 vpm and an amplitude of between about 0–7850 cfp, the frequency and amplitude of said high frequency, low amplitude vibrations being higher and lower respectively than the frequency and amplitude of said low frequency, high amplitude vibrations.

8. The apparatus of claim 7, wherein said screen is inclined at an angle of about 20° from the horizontal.

9. The apparatus of claim 1, wherein said screen is inclined at an angle of about 20° from the horizontal.

10. The apparatus of claim 1, wherein the openings in said screen are about 18 mesh or smaller in size.

11. The apparatus of claim 10, wherein said openings are approximately square in shape.

12. The apparatus of claim 7, wherein the openings in said screen are about 18 mesh or smaller in size.

13. The apparatus of claim 12, wherein said openings are approximately square in shape.

14. The apparatus of claim 9, wherein the openings in said screen are about 18 mesh or smaller in size.

15. The apparatus of claim 14, wherein said openings are approximately square in shape.

16. A method of separating particulate solids of larger and smaller sizes from each other, comprising introducing the solids to be separated to the inlet end of a longitudinally extending inclined screening deck having a longitudinally extending frame and a substantially planar inclined screen mounted in the frame with openings therethrough;

imparting high frequency, low amplitude vibrations directly to the screen to exert forces on said screen in a direction transverse to the plane of the screen;

simultaneously imparting low frequency, high amplitude vibrations to the frame and screen therein at a location intermediate the longitudinal length of the frame and to also exert forces on said screen in a direction transverse to the plane of the screen, the transverse high frequency and low frequency forces preventing particulate solids from pegging in the screen openings;

removing the smaller size particulate solids which pass through the vibrating screen; and removing the larger size particulate solids which do not pass through the vibrating screen.

17. The method of claim 16, wherein said high frequency, low amplitude vibrations are imparted to the screen independently of the frame.

18. The method of claim 16, including sequentially passing the particulate solids to be separated across a pair of said screens in said frame, imparting high frequency, low amplitude vibrations to each of said screens, the frequency of the high frequency, low amplitude vibrations which are imparted to each of the screen differing from each other.

19. The method of claim 17, including sequentially passing the particulate solids to be separated across a pair of said screens, imparting high frequency, low amplitude vibrations to each of said screens, the frequency of the high frequency, low amplitude vibrations which are imparted to each of the screens differing from each other.

20. The method of claim 16, wherein said high frequency, low amplitude vibrations have a frequency of between about 1000–7000 vpm and an amplitude of between about 600–1350 cfp, and said low frequency, high amplitude vibrations have a frequency of between about 900–3600 vpm and an amplitude of between about 0–7850 cfp, the frequency and amplitude of said high frequency, low amplitude vibrations being high and lower respectively than the frequency and amplitude of said low frequency, high amplitude vibrations.

21. The method of claim 18, wherein said high frequency, low amplitude vibrations have a frequency of between about 1000–7000 vpm and an amplitude of between about 600–1350 cfp, and said low frequency, high amplitude vibrations have a frequency of between about 900–3600 vpm and an amplitude of between about 0–7850 cfp, the frequency and amplitude of said high frequency, low amplitude vibrations being higher and lower respectively than the frequency and amplitude of said low frequency, high amplitude vibrations.

22. The method of claim 16, wherein said screen is inclined at an angle of about 20° from the horizontal.

23. The method of claim 18, wherein said screens are inclined at an angle of about 20° from the horizontal.

24. The method of claim 20, wherein said screen is inclined at an angle of about 20° from the horizontal.

25. The method of claim 16, wherein the openings in the screen are about 18 mesh or smaller in size.

26. The method of claim 25, wherein said openings are approximately square in shape.

27. The method of claim 20, wherein the openings in the screen are about 18 mesh or smaller in size.

28. The method of claim 27, wherein said openings are approximately square in shape.

29. The method of claim 24, wherein the openings in the screens are about 18 mesh or smaller in size.

30. The method of claim 29, wherein said openings are approximately square in shape.

31. Classifying apparatus including a longitudinally extending screening deck for separating particulate solids of larger and smaller sizes from each other as the solids move longitudinally along the deck, said screening deck comprising:

a longitudinally extending frame;

at least one substantially planar screen having openings therein to permit the passage of the smaller particulate solids therethrough and being inclined at an angle of about 20° from the horizontal;

mounting means for mounting said inclined screen in said frame;

first vibration means imparting high frequency, low amplitude vibrations to said screen to exert forces on said screen in a direction transverse to the plane of the screen; and second vibration means imparting low frequency, high amplitude vibrations to said screen simultaneously with said high frequency, low amplitude vibrations imparted to said screen and to also exert forces on said screen in a direction transverse to the plane of the screen, the transverse high frequency and low frequency forces preventing particulate solids from pegging in the screen openings.

32. The apparatus of claim 31, wherein said first vibration means imparts said high frequency, low amplitude vibrations directly to said screen to vibrate the screen independently of said frame.

33. The apparatus of claim 32, including resilient mounting means mounting said first vibration means to said frame.

34. The apparatus of claim 31, including mounting means mounting said second vibration means to said frame to impart said low frequency, high amplitude vibrations to the frame and said screen.

35. The apparatus of claim 32, including mounting means mounting said second vibration means to said frame to impart said low frequency, high amplitude vibrations to the frame and said screen.

36. The apparatus of claim 31, including a pair of inclined said screens, each of said screens being vibrated by said first vibration means independently of each other.

37. The apparatus of claim 36, wherein said first vibration means imparts said high frequency, low amplitude vibrations directly to each of said screens to vibrate the screens independently of said frame; resilient mounting means mounting said first vibration means to said frame; and said second vibration means imparting said low frequency, high amplitude vibrations to the frame and each of said inclined screens.

38. The apparatus of claim 37, wherein said high frequency, low amplitude vibrations have a frequency of between about 1000–7000 vpm and an amplitude of between about 600–1350 cfp, and said low frequency, high amplitude vibrations have a frequency of between about 900–3600 vpm and an amplitude of between about 0–7850 cfp, the frequency and amplitude of said high frequency, low amplitude vibrations being higher and lower respectively than the frequency and amplitude of said low frequency, high amplitude vibrations.

39. The apparatus of claim 31, wherein said high frequency, low amplitude vibrations have a frequency of between about 1000–7000 vpm and an amplitude of between about 600–1350 cfp, and said low frequency, high amplitude vibrations have a frequency of between about 900–3600 vpm and an amplitude of between about 0–7850 cfp, the frequency and amplitude of said high frequency, low amplitude vibrations being higher and lower respectively than the frequency and amplitude of said low frequency, high amplitude vibrations.

40. The apparatus of claim 31, wherein the openings in said screen are about 18 mesh or smaller in size.

41. The apparatus of claim 40, wherein said openings are approximately square in shape.

42. The apparatus of claim 39, wherein the openings in said screen are about 18 mesh or smaller in size.

43. The apparatus of claim 42, wherein said openings are approximately square in shape.

44. A method of separating particulate solids of larger and smaller sizes from each other, comprising introducing the solids to be separated to the inlet end of a longitudinally extending screening deck having a longitudinally extending frame, and a substantially planar screen mounted in the frame with openings therethrough and which is inclined at an angle of about 20° from the horizontal;

imparting high frequency, low amplitude vibrations to the screen to exert forces on said screen in a direction transverse to the plane of the screen;

simultaneously imparting low frequency, high amplitude vibrations to the screen to cause the particulate solids to move longitudinally along the screening deck from its inlet end, said low frequency, high amplitude vibrations also exerting forces on said screen in a direction transverse to the plane of said screen, the transverse high frequency and low frequency forces preventing particulate solids from pegging in the screen openings;

removing the smaller size particulate solids as they move along the screen by passing them through the openings in the vibrating screen; and removing the larger size particulate solids which do not pass through the openings in the vibrating screen by moving them along the screen.

45. The method of claim 44, wherein said high frequency, low amplitude vibrations are imparted directly to the screen and independently of the frame.

46. The method of claim 45, wherein said low frequency, high amplitude vibrations are imparted to the frame.

47. The method of claim 44, wherein said low frequency, high amplitude vibrations are imparted to the frame.

48. The method of claim 44, including sequentially passing the particulate solids to be separated across a pair of said inclined screens, imparting high frequency, low amplitude vibrations to each of said inclined screens, the frequency of the high frequency, low amplitude vibrations which are imparted to each of the screens differing from each other.

49. The method of claim 46, including sequentially passing the particulate solids to be separated across a pair of said inclined screens, imparting high frequency, low amplitude vibrations to each of said inclined screens, the frequency of the high frequency, low amplitude vibrations which are imparted to each of the screens differing from each other.

50. The method of claim 44, wherein said high frequency, low amplitude vibrations have a frequency of between about 1000–7000 vpm and an amplitude of between about 600–1350 cfp, and said low frequency, high amplitude vibrations have a frequency of between about 900–3600 vpm and an amplitude of between about 0–7850 cfp, the frequency and amplitude of said high frequency, low amplitude vibrations being higher and lower respectively than the frequency and amplitude of said low frequency, high amplitude vibrations.

51. The method of claim 48, wherein said high frequency, low amplitude vibrations have a frequency of between about 1000–7000 vpm and an amplitude of between about 600–1350 cfp, and said low frequency, high amplitude vibrations have a frequency of between about 900–3600 vpm and an amplitude of between about 0–7850 cfp, the frequency and amplitude of said high frequency, low amplitude vibrations being higher and lower respectively than the frequency and amplitude of said low frequency, high amplitude vibrations.

52. The method of claim 44, wherein the openings in the screen are about 18 mesh or smaller in size.

53. The method of claim 52, wherein said openings are approximately square in shape.

54. The method of claim 50, wherein the openings in the screen are about 18 mesh or smaller in size.

55. The method of claim 54, wherein said openings are approximately square in shape.

56. The apparatus of claim 1, wherein said first vibration means includes tappet means in continuous direct contact with said screen having openings therein.

57. The method of claim 16, wherein the high frequency, low amplitude vibrations are imparted to said screen by vibration inducing means which continuously contacts and supports said screen.

58. The apparatus of claim 31, wherein said first vibration means includes tappet means in continuous direct contact with said screen having openings therein.

59. The method of claim 44, wherein the high frequency, low amplitude vibrations are imparted to said screen by vibration inducing means which continuously contacts and supports said screen.

* * * * *

UNITED STATES PATENT AND TRADEMARK OFFICE

CERTIFICATE OF CORRECTION

PATENT NO. : 5,232,099

DATED : August 3, 1993

INVENTOR(S) : Michael W. Maynard

It is certified that error appears in the above-indentified patent and that said Letters Patent is hereby corrected as shown below:

In the drawings FIGS. 1-3, the reference numeral "24" with a lead arrow should be applied to the rectangular frame having the side member "26".

Col. 1, line 22, "screen solids" should read --screen, solids--.

Col. 4, line 55, after "materials" insert --, gravity functions to slide the particulate solid material--.

Col. 6, line 43, "cpf" should read --cfp--.

Col. 7, line 7, "line" should read --lime--.

Signed and Sealed this

Eighteenth Day of April, 1995

Bruce Lehman

*Attest:*

BRUCE LEHMAN

*Commissioner of Patents and Trademarks*

*Attesting Officer*